US009969191B2

(12) United States Patent
Masubuchi et al.

(10) Patent No.: US 9,969,191 B2
(45) Date of Patent: May 15, 2018

(54) LABEL DIE CUTTING MACHINE, PRINTING DEVICE, AND LABEL DIE CUTTING METHOD

(71) Applicant: Seiko Epson Corporation, Tokyo (JP)

(72) Inventors: Hiroyuki Masubuchi, Matsumoto (JP); Hironori Maekawa, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days. days.

(21) Appl. No.: 15/351,874

(22) Filed: Nov. 15, 2016

(65) Prior Publication Data

US 2017/0136788 A1 May 18, 2017

(30) Foreign Application Priority Data

Nov. 16, 2015 (JP) ..... 2015-223672
Nov. 16, 2015 (JP) ..... 2015-223673
Nov. 16, 2015 (JP) ..... 2015-223674

(51) Int. Cl.

| | |
|---|---|
| ***B41J 11/70*** | (2006.01) |
| ***B26F 1/44*** | (2006.01) |
| ***B26F 1/24*** | (2006.01) |
| ***B31D 1/02*** | (2006.01) |
| ***B41J 3/407*** | (2006.01) |
| ***B41J 11/66*** | (2006.01) |
| ***B65C 9/44*** | (2006.01) |
| *B26F 1/38* | (2006.01) |

(52) U.S. Cl.

CPC ..... *B41J 11/70* (2013.01); *B26F 1/24* (2013.01); *B26F 1/44* (2013.01); *B31D 1/026* (2013.01); *B31D 1/027* (2013.01); *B41J 3/4075* (2013.01); *B41J 11/663* (2013.01); *B65C 9/44* (2013.01); *B26F 2001/388* (2013.01)

(58) Field of Classification Search

CPC ..... B41J 11/70; B41J 11/663; B41J 3/4075; B26F 1/24; B26F 1/00; B26F 1/44; B26F 1/38; B26F 1/3853; B26F 2001/388; B26F 2001/4472; B26F 2001/4481; B26F 2001/3893; B65C 9/44; B31D 1/026; B31D 1/027

USPC ..... 347/104

See application file for complete search history.

(56) References Cited

U.S. PATENT DOCUMENTS

| | | | |
|---|---|---|---|
| 6,760,125 B1 | 7/2004 | Hayama | |
| 2002/0113986 A1 | 8/2002 | MacDonald | |

(Continued)

FOREIGN PATENT DOCUMENTS

| | | | | |
|---|---|---|---|---|
| JP | 63-099970 A | | 5/1988 | |
| JP | 04-173256 | * | 6/1992 | ..... B41J 11/66 |

(Continued)

*Primary Examiner* — Huan Tran
*Assistant Examiner* — Alexander D Shenderov
(74) *Attorney, Agent, or Firm* — Nutter McClennen & Fish LLP; John J. Penny, Jr.

(57) ABSTRACT

A label die cutting device enables easily changing the shape of the die cut made in label paper. A printer 1 has a print unit 7 and a die cutting process unit 8 (label die cutting device). The die cutting process unit 8 has a conveyance path 9 for conveying the label paper 5, a die cutting unit including wire pins 41 and a wire pin drive mechanism 42 for advancing and retracting the wire pins 41, and a die cutting controller 68 for driving the wire pin drive mechanism 42 to strike the wire pins 41 against the label paper 5 on the conveyance path 9 and die cut the label paper 5 based on print data. The die cutting unit is a wire dot head 27.

15 Claims, 9 Drawing Sheets

(56) References Cited

U.S. PATENT DOCUMENTS

| | | | | |
|---|---|---|---|---|
| 2003/0206211 | A1 | 11/2003 | Baron | |
| 2004/0085422 | A1 | 5/2004 | Kelley | |
| 2004/0175191 | A1* | 9/2004 | Jingu | B41J 3/546 399/2 |
| 2006/0204309 | A1* | 9/2006 | Gilmour | B41J 11/663 400/621 |
| 2008/0166166 | A1 | 7/2008 | Berstis et al. | |

FOREIGN PATENT DOCUMENTS

| | | | |
|---|---|---|---|
| JP | 04-173256 | A | 6/1992 |
| JP | 06-027156 | U | 4/1994 |
| JP | 10-086466 | A | 4/1998 |
| JP | 11-277879 | A | 10/1999 |
| JP | 11-348262 | A | 12/1999 |
| JP | 2000-332986 | A | 11/2000 |
| JP | 2001-001425 | A | 1/2001 |
| JP | 2001-001586 | A | 1/2001 |
| JP | 2001-001602 | A | 1/2001 |
| JP | 2001-010133 | A | 1/2001 |
| JP | 2001-096494 | A | 4/2001 |
| JP | 2002-132161 | A | 5/2002 |
| JP | 2005-343103 | A | 12/2005 |
| JP | 2006-053570 | A | 2/2006 |
| JP | 2007-161359 | A | 6/2007 |
| JP | 2009-274170 | A | 11/2009 |
| JP | 2013-039684 | A | 2/2013 |
| JP | 2015-030054 | A | 2/2015 |

* cited by examiner

LABEL DIE CUTTING MACHINE, PRINTING DEVICE, AND LABEL DIE CUTTING METHOD

BACKGROUND

1. Technical Field

The present invention relates to a label die cutting machine for die cutting labels, a printing device that prints on label paper and die cuts labels, and a label die cutting method for die cutting label paper.

2. Related Art

JP-A-2001-096494 describes a system having a print unit that prints on label paper having peel-able labels affixed at a constant interval to a web liner, and a die cutting unit that die cuts labels on label paper discharged from the print unit. The die cutting unit has a die roller with a cutting die disposed thereto, a platen roller disposed opposite the die roller so the label paper passes therebetween, and a conveyance mechanism for conveying the label paper past the die cutting position of the die roller and the platen roller. When passing the die cutting position, the die is pressed into the label paper and the labels are die cut.

To change the shape of the die for cutting labels in the device described in JP-A-2001-096494, the die must be changed, and the die roller must be replaced. Responding quickly to changes in label shape is therefore difficult.

SUMMARY

A label die cutting machine, a printing device, and a label die cutting method according to the invention enable easily changing the die cut shape of the labels.

To achieve the foregoing objective, a label die cutting device according to the invention has a conveyance path through which label paper is conveyed; a die cutting unit having wire pins and a wire pin moving mechanism that drives the wire pins forward and back; and a die cutting controller configured to drive the wire pin moving mechanism to advance the wire pins, strike the label paper on the conveyance path with the wire pins, and die cut the label paper based on print data.

This configuration can die cut label paper by striking label paper on the conveyance path with wire pins. The shape of the die cut can therefore be changed by controlling the positions where the wire pins strike the label paper. Furthermore, because the wire pin moving mechanism is controlled based on print data, label paper can be die cut to a shape conforming to the printing area of the print data. Note that die cutting label paper as used herein includes both kiss cutting only the label portion or die cutting through the label and liner.

The die cutting unit of the invention is preferably a wire dot head.

This configuration can easily control the wire pin moving mechanism based on the print data.

Further preferably, the wire pins have a rectangular shape when seen from the axial end.

This configuration can form straight edges in the cut portion when die cutting label paper with wire pins.

The label die cutting device of the invention further preferably has a striking force controller configured to adjust the striking force of the wire pins striking the label paper.

This configuration can flexibly adjust the depth of the die cut in the label paper by adjusting the striking force with which the wire pins strike the label paper.

Further preferably, the wire pin moving mechanism has a drive coil that drives the wire pins; the die cutting controller drives the wire pin moving mechanism by energizing the drive coil; and the striking force controller controls energizing the drive coil and adjusts the striking force.

If the wire pin moving mechanism comprises a solenoid and a drive coil, and uses electromagnetic force to move the wire pins, the speed (acceleration) at which the wire pins move changes and the striking force of the wire pins against the label paper can be adjusted, by controlling energizing the drive coil by adjusting the current, voltage, or energizing time, for example.

Further preferably, the striking force controller has a gap adjusting mechanism configured to adjust the gap between the die cutting unit and the conveyance path.

This configuration can increase the striking force of the wire pins on the label paper by reducing the gap between the die cutting unit and the conveyance path, and can decrease the striking force of the wire pins on the label paper by increasing the gap between the die cutting unit and the conveyance path.

Further preferably, the striking force controller sets the striking force of the wire pins against the label paper to a first striking force causing the wire pins to pass through the label, or a second striking force causing the wire pins to pass through the label and the liner.

This configuration enables die cutting the label paper through the label and liner, or kiss cutting only the label portion.

Another aspect of the invention is a printing device including: a printhead; a die cutting unit having wire pins and a wire pin moving mechanism that drives the wire pins forward and back; a conveyance path through which label paper is conveyed; a conveyance mechanism configured to convey the label paper through the conveyance path; print control unit configured to drive the printhead based on print data and print on the label paper on the conveyance path; and a die cutting controller configured to drive the wire pin moving mechanism to advance the wire pins, strike the label paper on the conveyance path with the wire pins, and die cut the label paper based on the print data.

This configuration can die cut label paper by striking label paper on the conveyance path with wire pins. The shape of the die cut can therefore be changed by controlling the positions where the wire pins strike the label paper. Furthermore, because the wire pin moving mechanism is controlled based on print data, label paper can be die cut to a shape conforming to the area that is printed based on the print data.

The printing device preferably also has a first platen defining a first conveyance path part opposite the printhead on the conveyance path; and a second platen defining a second conveyance path part opposite the die cutting unit on the conveyance path. The first platen and the second platen are suction platens; and a suction mechanism includes the second platen.

This configuration can reduce the dispersion of paper dust produced by the wire pins striking the label paper. The label paper can also be prevented from lifting away from the conveyance path.

The printing device preferably also has a printer module and an auxiliary module that is removably installable to the printer module; the conveyance path includes a first conveyance path part and a second conveyance path part that removably connects to the first conveyance path part; the printer module includes the first conveyance path part and the printhead; and the auxiliary module includes the second conveyance path part and the die cutting unit.

This configuration can print on label paper by the printer module including a printhead. By connecting the auxiliary module with a die cutting unit to the printer module as needed, printing on the label paper and die cutting the label paper can be done in a single continuous process.

The printing device preferably also has a conveyance controller configured to drive the conveyance mechanism based on the print data; and a correction unit configured to correct deviation between the striking position where the die cutting unit strikes the label paper with the wire pins, and a target striking position previously set on the label paper.

When the actual striking position where the wire pins of the die cutting unit strike the recording paper deviates from the target striking position, the correction unit in this configuration can correct the offset by moving the striking position of the wire pins in the direction eliminating the deviation.

In another aspect of the invention, the correction unit controls the conveyance mechanism and adjusts the conveyance distance of the label paper from the printing position to the die cutting position based on the offset between the striking position and the target striking position in the conveyance direction of the label paper.

When the printing area and the die cutting area on the label paper are offset in the conveyance direction due to the actual striking position deviating from the target striking position, the offset can be corrected by adjusting the distance the label paper is conveyed between the printing position and the die cutting position.

In another aspect of the invention, the correction unit controls the conveyance mechanism based on the offset in the conveyance direction of the label paper between the striking position and the target striking position, and moves the printing start position where the print control unit starts printing on the label paper in the conveyance direction.

When the printing area and the die cutting area on the label paper are offset in the conveyance direction due to the actual striking position deviating from the target striking position, this configuration moves the position where the printhead starts printing on the recording paper in the conveyance direction and adjusts the relative positions of the printing area and the die cutting area. Offset between the striking position and the target striking position can therefore be corrected.

The printing device according to another aspect of the invention preferably also has a printhead moving mechanism configured to move the printhead transversely to the conveyance direction of the label paper. The print control unit drives the printhead and prints on the label paper while driving the printhead moving mechanism to move the printhead in the transverse direction; and the correction unit corrects the timing at which the print control unit drives the printhead based on the offset in the transverse direction between the striking position and the target striking position.

When the printing area and the die cutting area on the label paper are offset in the direction transverse to the conveyance direction due to the actual striking position deviating from the target striking position, this configuration shifts the timing for driving the printhead moving in the transverse direction and moves the printing area in the transverse direction. Offset between the striking position and the target striking position can therefore be corrected.

In another aspect of the invention, the correction unit has an input unit to receive the offset amount.

This configuration prints and die cuts label paper based on print data, and can input the deviation between the printing area and the die cutting area measured by sensors or manually from the printing results and die cutting results to the correction unit as the offset between the striking position and the target striking position.

Another aspect of the invention is a label die cutting method controlling a device including a conveyance path through which label paper is conveyed, wire pins, and a wire pin moving mechanism that drives the wire pins forward and back, the method comprising; receiving print data; conveying label paper through the conveyance path; and driving the wire pin moving mechanism to advance the wire pins, strike the label paper on the conveyance path with the wire pins, and die cut the label paper based on the print data.

This configuration can die cut label paper by striking label paper on the conveyance path with wire pins. The shape of the die cut can therefore be changed by controlling the positions where the wire pins strike the label paper. Furthermore, because the wire pin moving mechanism is controlled based on print data, label paper can be die cut to a shape conforming to the printing area of the print data.

The label die cutting method preferably also adjusts the striking force of the wire pins on the label paper in the die cutting operation of striking the label paper with the wire pins and die cutting the label paper.

This configuration can die cut label paper by striking label paper on the conveyance path with wire pins. By adjusting the striking force with which the wire pins strike the label paper, the depth of the die cut in the label paper can be flexibly adjusted.

Further preferably, the label die cutting method includes, in the die cutting operation, setting the striking force of the wire pins against the label paper to a first striking force causing the wire pins to pass through the label, or a second striking force causing the wire pins to pass through the label and the liner.

This configuration enables die cutting the label paper through the label and liner, or kiss cutting only the label portion.

Other objects and attainments together with a fuller understanding of the invention will become apparent and appreciated by referring to the following description and claims taken in conjunction with the accompanying drawings.

DESCRIPTION OF EMBODIMENTS

Preferred embodiments of the present invention are described below with reference to the accompanying figures.

Embodiment 1

General Configuration

Figure 1:
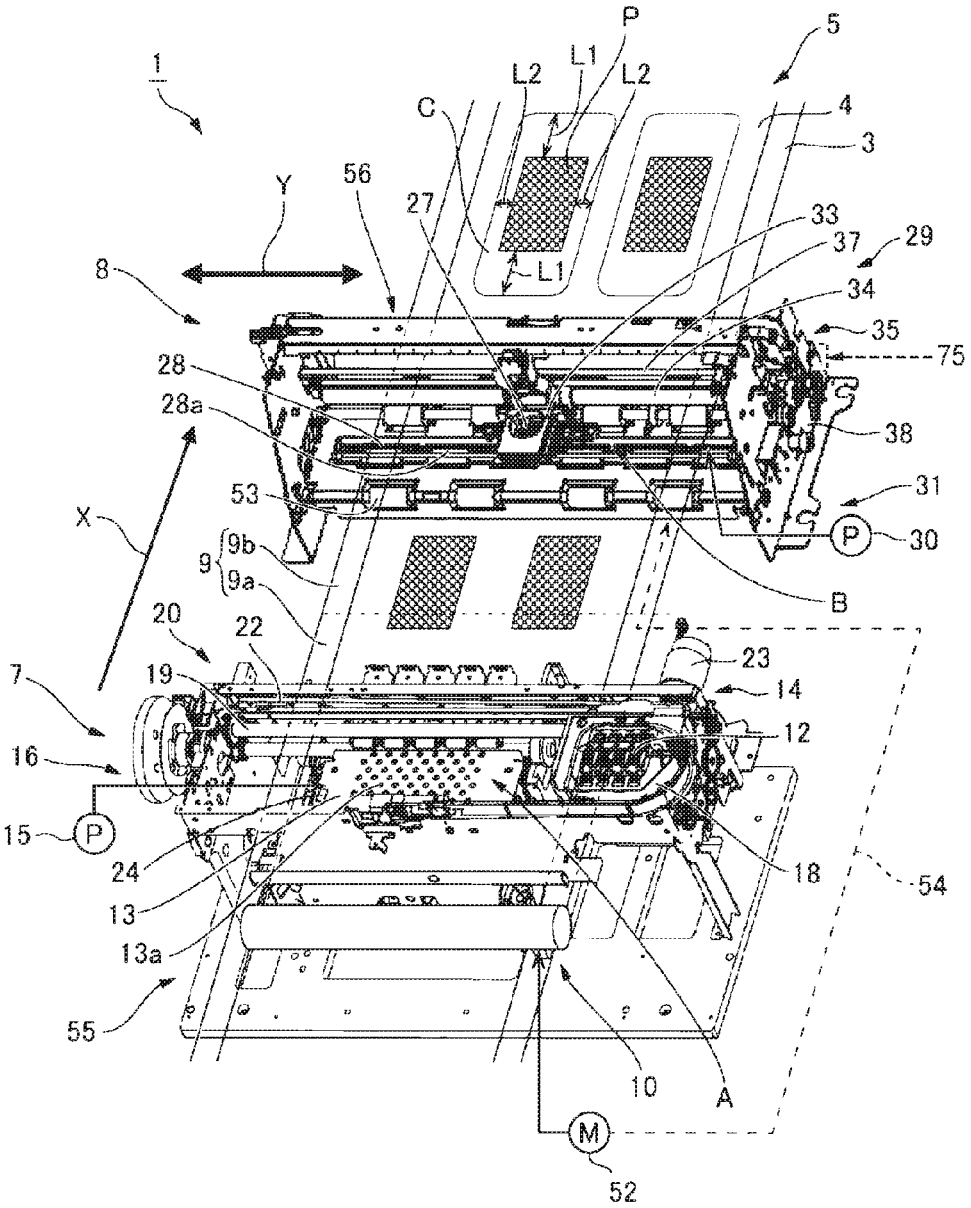
FIG. 1 is an oblique view showing the main parts of a printer according to the invention.

FIG. 1 is an oblique view showing the main parts of a printer according to the invention. The printer (printing device) 1 according to this embodiment is a label paper configured to print labels 4 affixed to a continuous web (liner) 3 and die cut label paper 5 including the continuous web 3 and the labels 4.

As shown in FIG. 1, the printer 1 has a print unit 7 for printing on the label paper 5, and a die cutting process unit 8 (label die cutting device) for die cutting the label paper 5. The printer 1 also has a conveyance path 9 passing the printing position A of the print unit 7 and the die cutting position B of the die cutting process unit 8, and a conveyance mechanism 10 for conveying the label paper 5 through the conveyance path 9. The conveyance path 9 includes a first conveyance path portion 9*a* and a second conveyance path portion 9*b* removably connected to the first conveyance path portion 9*a*. The first conveyance path portion 9*a* passes the printing position A, and the second conveyance path portion 9*b* passes the die cutting position B.

The print unit 7 includes a printhead 12, a printing platen 13 (first platen) as part of the first conveyance path portion 9*a* at the position opposite the printhead 12, and a printhead moving mechanism 14 that moves the printhead 12 in the primary scanning direction Y (transverse direction) perpendicular to the conveyance direction X of the label paper 5. The printhead 12 in this example is an inkjet head. The printing platen 13 determines the printing position A of the print unit 7. The printing platen 13 is a suction platen. More specifically, the printing platen 13 has intake holes 13*a* in the conveyance surface over which the label paper 5 passes. A printer-side suction pump 15 is connected to the intake holes 13*a*. The printing platen 13 and printer-side suction pump 15 embody a printer-side suction mechanism 16.

The printhead moving mechanism 14 includes a carriage 18 that carries the printhead 12, a carriage guide rail 19 extending on the primary scanning direction Y, and a carriage moving mechanism 20 that moves the carriage 18 along the carriage guide rail 19. The carriage 18 is supported movably on the carriage guide rail 19. The carriage moving mechanism 20 includes a pair of pulleys disposed to opposite ends of the carriage guide rail 19, and a timing belt 22 mounted on the pair of pulleys. The carriage 18 is connected to part of the timing belt 22. The carriage moving mechanism 20 also includes a printer-side carriage motor 23 as the drive source. Drive power from the printer-side carriage motor 23 is transferred to one of the pulleys.

The print unit 7 also includes a label position detector 24 that detects the position of a label 4 on the liner 3. The label position detector 24 in this example optically detects black marks BM (see FIG. 6) on the liner 3 of the label paper 5. Note that the label position detector 24 may be a detector that optically detects the gaps between adjacent labels 4 in the conveyance direction X.

The die cutting process unit 8 includes a wire dot head 27 (die cutting unit), a process unit platen 28 (second platen) as part of the second conveyance path portion 9*b* at the position opposite the wire dot head 27, and a process unit-side printhead moving mechanism 29 that moves the wire dot head 27 in the primary scanning direction Y. The process unit platen 28 is a suction platen. More specifically, the process unit platen 28 has intake holes 28*a* in the conveyance surface over which the label paper 5 passes. A process unit-side suction pump 30 is connected to the intake holes 28*a*. The process unit platen 28 and process unit-side suction pump 30 embody a process unit-side suction mechanism 31.

The process unit-side printhead moving mechanism 29 includes a carriage 33 that carries the wire dot head 27, a carriage guide rail 34 extending on the primary scanning direction Y, and a carriage moving mechanism 35 that moves the carriage 33 along the carriage guide rail 34. The carriage 33 is supported movably on the carriage guide rail 34. The carriage moving mechanism 35 includes a pair of pulleys disposed to opposite ends of the carriage guide rail 34, and a timing belt 37 mounted on the pair of pulleys. The carriage 33 is connected to part of the timing belt 22. The carriage moving mechanism 35 also includes a process unit-side carriage motor 38 as the drive source. Drive power from the process unit-side carriage motor 38 is transferred to one of the pulleys.

Figure 2:
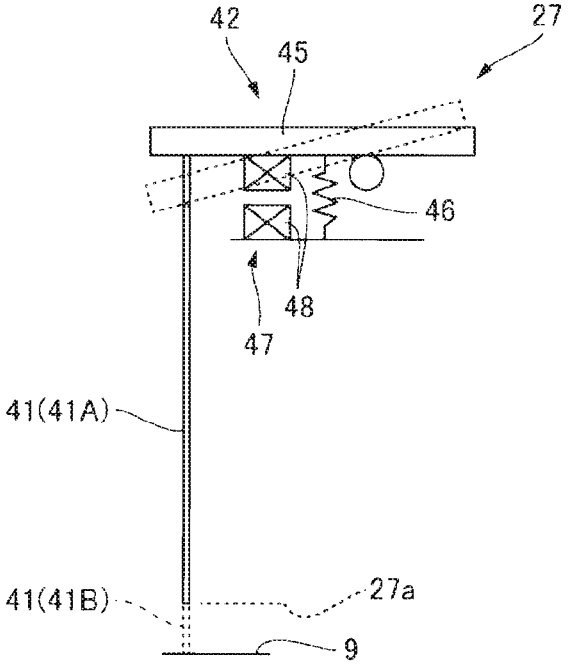
FIG. 2 illustrates the wire pin moving mechanism.

FIG. 2 illustrates the construction of the wire dot head 27. The wire dot head 27 has numerous wire pins 41 arrayed in a matrix. The wire pins 41 extended perpendicularly to the conveyance surface of the conveyance path 9. When seen from the axial end, each of the wire pins 41 has a rectangular shape.

The wire dot head 27 has a wire pin drive mechanism 42 that moves the wire pins 41 out and back to and away from the conveyance path 9. When a wire pin 41 moves up and away from the conveyance path 9 to the retracted position 41A, the distal end of the wire pin 41 is located above the head face 27*a* of the wire dot head 27. When a wire pin 41 moves to the extended forward position 41B, the distal end of the wire pin 41 protrudes forward (down) from the head face 27*a*.

The die cutting process unit 8 cuts the label paper 5 by driving the wire pin drive mechanism 42 to impel the wire pins 41 and strike the label paper 5 on the conveyance path 9. Note that if an ink ribbon is used, the wire dot head 27 can be used to print on the label paper 5. In other words, if an ink ribbon is disposed between the wire dot head 27 and the label paper 5 on the conveyance path 9, the wire pin 41 will strike the ink ribbon, transfer ink from the ink ribbon to the label paper 5, and print an image. In this example, however, an ink ribbon is not used in the die cutting process unit 8.

The wire pin drive mechanism 42 has a metal drive plate 45 connected transversely to the wire pin 41 at the back end of the wire pin 41, an urging member 46 that urges the wire pin 41 or drive plate 45 in the direction away from the conveyance path 9, and an actuator 47 that moves the wire pin 41 in the direction toward the conveyance path 9 in resistance to the urging force of the urging member 46. The drive plate 45 is supported so that it can rock up and down. The actuator 47 is an electromagnetic device with a drive coil 48. When the drive coil 48 is energized, the actuator 47 attracts the drive plate 45 and moves the wire pin 41 from the retracted position 41A to the forward position 41B. When energizing the drive coil 48 stops, attraction of the drive plate 45 by the actuator 47 also stops, and the urging force of the urging member 46 returns the wire pin 41 to the retracted position 41A. The urging member 46 in this example is a coil spring. The actuator 47 in this example is a solenoid.

As shown in FIG. 1, the conveyance mechanism 10 has a main conveyance roller 51 disposed upstream in the conveyance direction X from the printing position A, and a conveyance motor 52 for driving the main conveyance roller 51. The conveyance mechanism 10 also has a transfer mechanism 54 for transferring output from the conveyance motor 52 to a secondary conveyance roller 53 disposed to the die cutting process unit 8.

The printer 1 includes a printer module 55 (main printer unit), and an auxiliary module 56 that is removably attached to the printer module 55. The printer module 55 includes the print unit 7, first conveyance path portion 9*a*, main conveyance roller 51, conveyance motor 52, and transfer mechanism 54. The auxiliary module 56 includes the die cutting process unit 8, second conveyance path portion 9*b*, and secondary conveyance roller 53. When the auxiliary module 56 is installed to the printer module 55, the first conveyance path portion 9*a* and second conveyance path portion 9*b* connect and form a continuous conveyance path 9. A drive power transfer path from the conveyance motor 52 through the transfer mechanism 54 to the secondary conveyance roller 53 is also completed when the auxiliary module 56 is connected to the printer module 55.

When print data is supplied from an external device, the printer 1 drives the conveyance motor 52 and conveys the label paper 5 intermittently through the conveyance path 9. The printer 1 also drives the printer-side suction pump 15 and process unit-side suction pump 30, and starts suctioning air through the printing platen 13 and process unit platen 28. The printer 1 also drives the printhead moving mechanism 14 to move the printhead 12 in the primary scanning direction Y while driving the printhead 12, and prints the print data on the label paper 5. The printer 1 also drives the process unit-side printhead moving mechanism 29 to move the wire dot head 27 on the primary scanning direction Y while driving the wire dot head 27 (wire pin drive mechanism 42) to strike the label paper 5 with the wire pins 41 and die cut the label paper 5.

Control System

Figure 3:
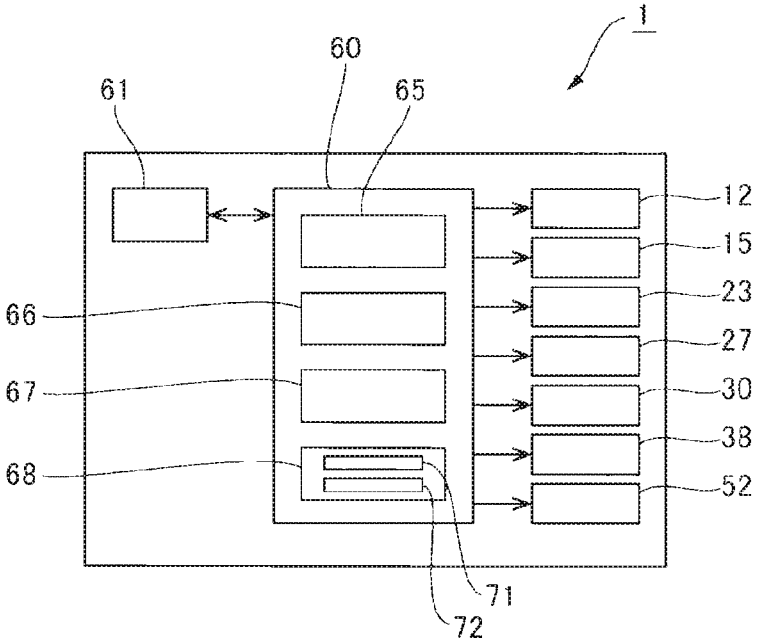
FIG. 3 is a block diagram of the printer control system.

FIG. 3 is a block diagram illustrating the control system of the printer 1. The control system of the printer 1 is built around a controller 60 comprising a CPU and other parts. A communication unit 61 with a communication interface for communicating with an external device is connected to the controller 60. The printhead 12, printer-side suction pump 15, printer-side carriage motor 23, wire dot head 27, process unit-side suction pump 30, process unit-side carriage motor 38, and conveyance motor 52 are connected to the output side of the controller 60.

The controller 60 includes a conveyance controller 65, suction controller 66, print controller 67, and die cutting controller 68. The conveyance controller 65 drives the conveyance motor 52 to convey the label paper 5 by the conveyance mechanism 10. The suction controller 66 drives the printer-side suction pump 15 and process unit-side suction pump 30 to suction air through the printing platen 13 and process unit platen 28.

The print controller 67 drives the printhead 12 and printer-side carriage motor 23 based on the print data to print the print data on the label paper 5 on the conveyance path 9. More specifically, the print controller 67 drives the printer-side carriage motor 23 to move the printhead 12 in the primary scanning direction Y while driving the printhead 12 to eject ink onto the labels 4. The print controller 67 thereby prints the print data at the printing position A.

The die cutting controller 68 has a die cutting data generator 71 and a drive controller 72. The die cutting data generator 71 generates the die cutting data based on the print data. In this example, the die cutting controller 68 first acquires a printing area P on the label 4 based on the print data (see FIG. 1). Next, the die cutting data generator 71 defines a die cutting area C that is larger than the acquired printing area P by a margin of a first dimension L1 added to the upstream side and downstream side of the in the conveyance direction X, and a margin of second dimension L2 added to the left and right sides in the primary scanning direction Y. The die cutting data generator 71 then generates the die cutting data based on the contour of the defined die cutting area C. The die cutting data is the same as print data for printing the contour of the die cutting area C.

The drive controller 72 drives the wire dot head 27 (wire pin drive mechanism 42) and process unit-side carriage motor 38 based on the die cutting data to strike the label paper 5 on the conveyance path 9 with the wire pins 41. More specifically, the drive controller 72 drives the process unit-side carriage motor 38 to move the wire dot head 27 in the primary scanning direction Y while driving the wire dot head 27 to strike the label paper 5 with the wire pins 41. As a result, the drive controller 72 die cuts the label paper 5 at the die cutting position B.

Printing and Die Cutting Operation

Figure 4:
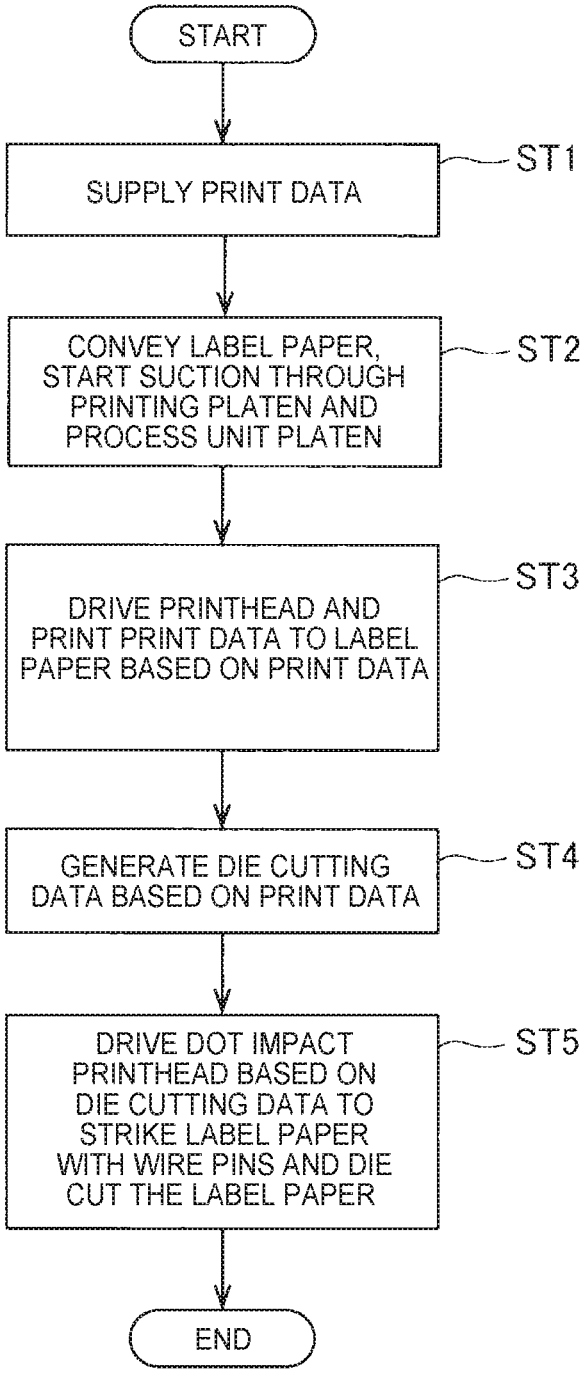
FIG. 4 is a flow chart of the printing and die cutting operation of the printer.

FIG. 4 is a flow chart of the printing and die cutting operation of the printer 1. The printer 1 first receives print data supplied to the printer 1 from an external device (step ST1). Upon receiving the print data, the printer 1 drives the conveyance motor 52 to intermittently convey the label paper 5 through the conveyance path 9. The printer 1 drives the printer-side suction pump 15 and process unit-side suction pump 30, and suctions air through the printing platen 13 and process unit platen 28 (step ST2).

Next, the printer 1 drives the printhead 12 and printer-side carriage motor 23 based on the print data, and prints the print data on the label paper 5 on the conveyance path 9 (step ST3). The printer 1 also generates the die cutting data based on the print data (step ST4). Based on the die cutting data, the printer 1 then drives the wire dot head 27 (wire pin drive mechanism 42) and the process unit-side carriage motor 38. As a result, the printer 1 strikes the label paper 5 on the conveyance path 9 with the wire pins 41, and performs a die cutting operation that die cuts the label paper 5 (step ST5).

The printer 1 in this example die cuts the label paper 5 by striking the label paper 5 on the conveyance path 9 with wire pins 41 of the wire dot head 27. Based on the die cutting data generated based on the print data, the printer 1 also controls the wire dot head 27 to die cut the label paper 5. The printer 1 can therefore die cut the label paper 5 to a shape corresponding to the printing area P of the print data. Because a wire dot head 27 is used for die cutting the label paper 5 in this example, the wire pin drive mechanism 42 can be easily controlled based on the die cutting data.

Furthermore, because the wire pins 41 have a rectangular shape when seen from the axial end, straight edges are formed at the cut when the label paper 5 is die cut by the wire pins 41.

The process unit platen 28 in this example is also a suction platen and suction is applied through the process unit platen 28 during the die cutting operation. Paper dust resulting from striking the label paper 5 with the wire pins 41 is therefore also vacuumed. Paper dust clinging to the label paper 5 is therefore suppressed. Dispersion of the paper dust to the printing position A side is also prevented or suppressed. Furthermore, because the printing platen 13 and process unit platen 28 are both suction platens, the label paper 5 is prevented from lifting away from the conveyance path 9 at the printing position A and die cutting position B.

The auxiliary module 56 having the die cutting process unit 8 is also removably attachable to the printer module 55 having the print unit 7. The operator can therefore print to label paper 5 using only the printer module 55. By installing the auxiliary module 56 to the printer module 55 as needed, the operator can also print to the label paper 5 and die cut the label paper 5 in a single continuous operation.

Other Examples of Embodiment 1

A continuous line is converted to the die cutting data in the example above, but a dotted-line contour may also be converted to die cutting data. Die cutting in this case forms a perforated line.

The die cutting data generator 71 in the above example defines the die cutting area C based on print data, but specific die cutting data may be previously registered and the die cutting operation performed based on the registered die cutting data.

Die cutting data may also be included in the print data supplied to the printer 1. In this case, the die cutting controller 68 drives the wire dot head 27 (wire pin drive mechanism 42) and process unit-side carriage motor 38 based on the die cutting data contained in the print data to strike the label paper 5 on the conveyance path 9 with the wire pins 41 at the die cutting position B and die cut the label paper 5.

The die cutting process unit 8 includes a process unit platen 28 in the above example, but a suction mechanism having a nozzle-like intake may be used instead of the process unit platen 28, and the suction mechanism may vacuum paper dust produced by striking the label paper 5 with the wire pins 41.

The print unit 7 and then the die cutting process unit 8 are disposed from the upstream side to the downstream side in the conveyance direction X of the label paper 5 in the above example, but the die cutting process unit 8 may be on the upstream side and the print unit 7 disposed downstream therefrom.

The die cutting process unit 8 in the above example strikes the label paper 5 with wire pins 41 while moving the wire dot head 27 in the primary scanning direction Y to die cut the label paper 5, but the wire pins 41 may be arrayed in a line from one side to the other side of the conveyance path 9 in the primary scanning direction Y. In other words, a line head may be used as the wire dot head 27.

Embodiment 2

A second embodiment of the invention is described next with reference to accompanying figures.

Note that like parts in the figures referenced above and the figures referenced below and following description are identified by like reference numerals and further description thereof is omitted.

Control System

Figure 5:
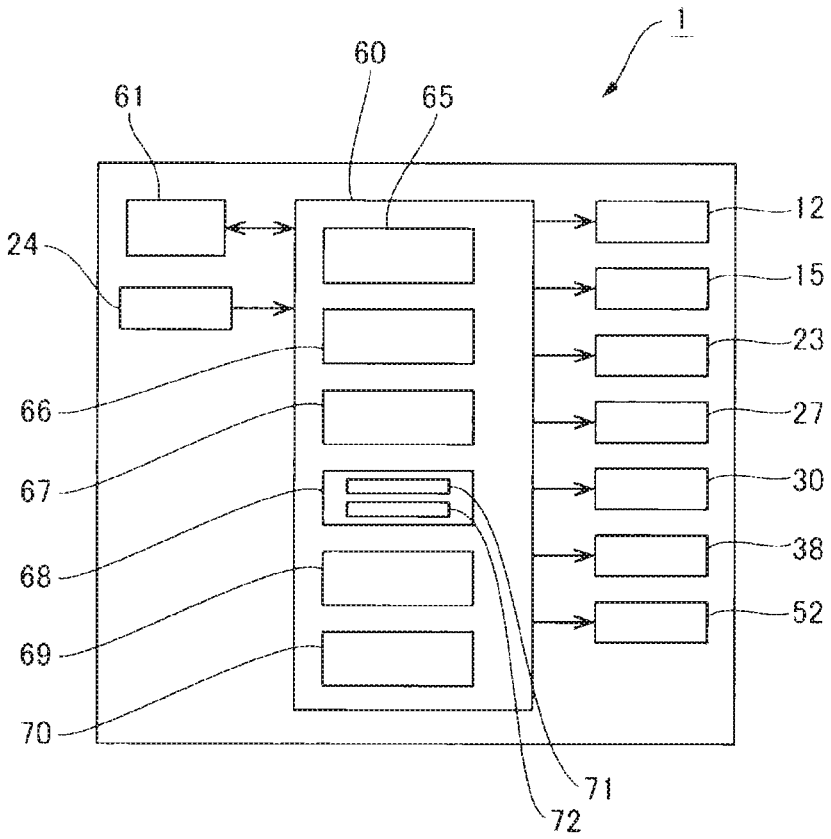
FIG. 5 is a block diagram illustrating another example of the printer 1 control system.
Figure 6:
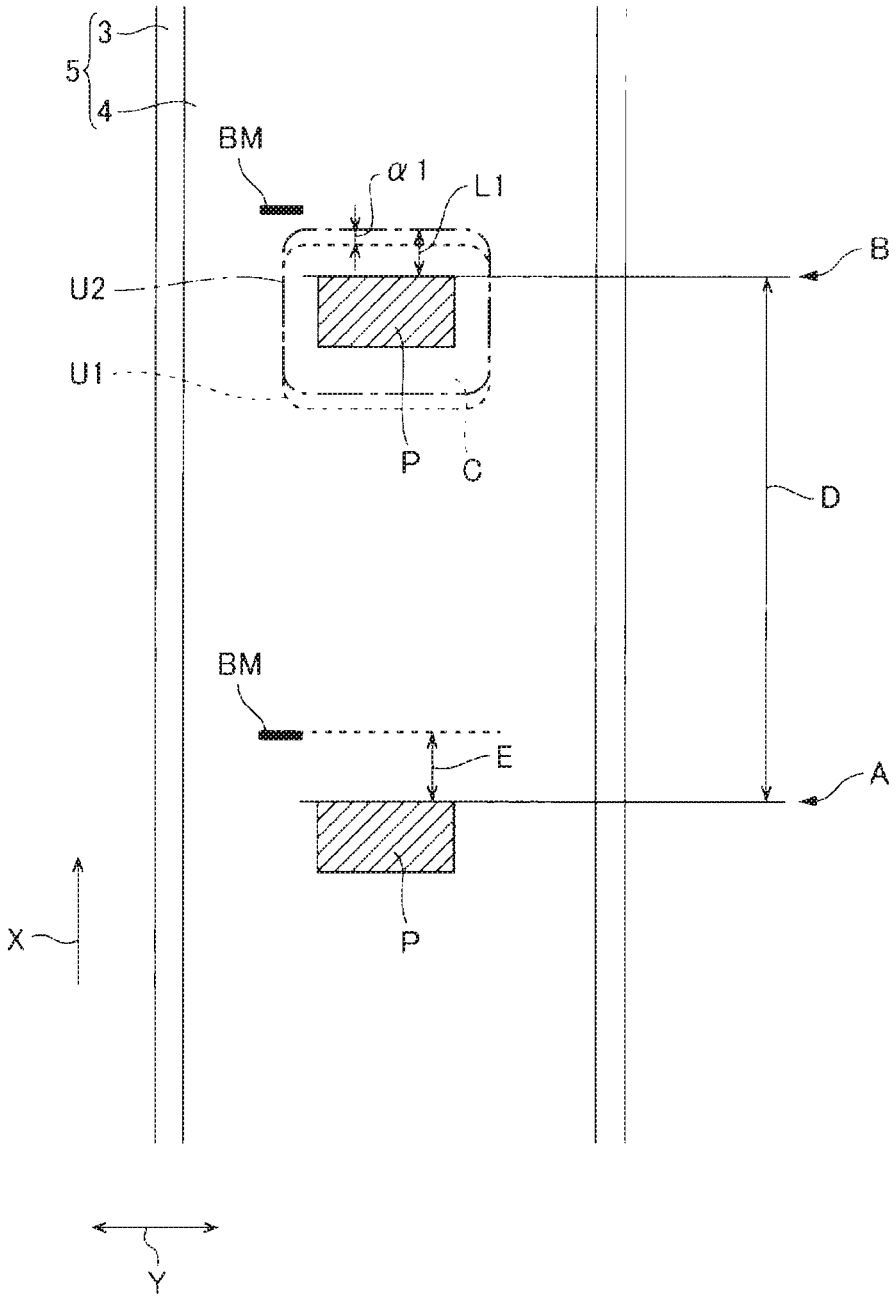
FIG. 6 illustrates the offset between the actual striking position and the target striking position in the conveyance direction of the medium.
Figure 7:
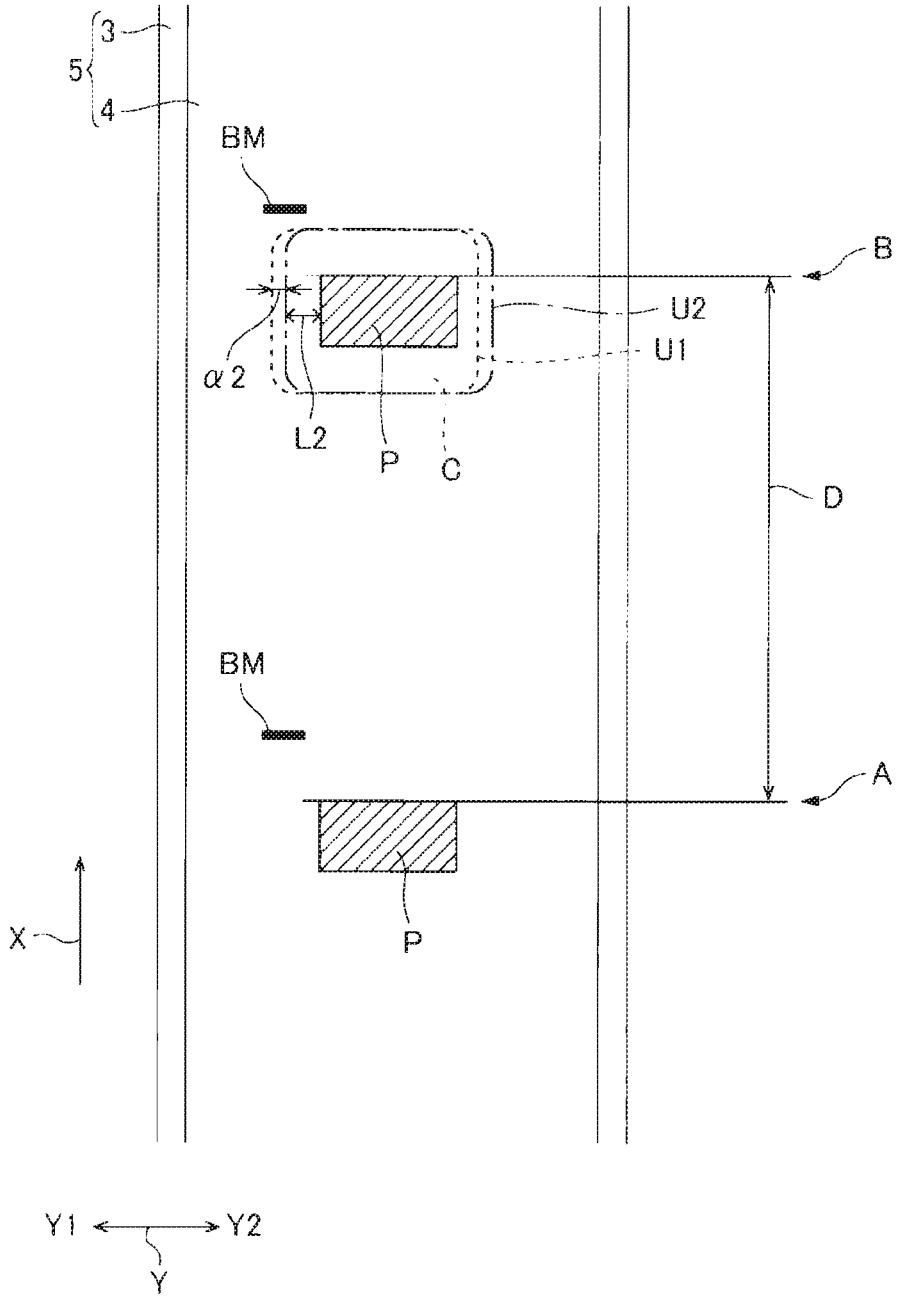
FIG. 7 illustrates the offset between the actual striking position and the target striking position in the primary scanning direction.

FIG. 5 is a block diagram illustrating another example of a control system for the printer 1. FIG. 6 illustrates the offset between the actual striking position and the target striking position in the conveyance direction of the medium. FIG. 7 illustrates the offset between the actual striking position and the target striking position in the primary scanning direction.

The control system of the printer 1 is built around a controller 60 comprising a CPU and other parts. A communication unit 61 is connected to the controller 60. A label position detector 24 is connected to the input side of the controller 60. The printhead 12, printer-side suction pump 15, printer-side carriage motor 23, wire dot head 27, processing unit-side suction pump 30, processing-unit side carriage motor 38, and conveyance motor 52 are connected to the output side of the controller 60.

The controller 60 includes a conveyance controller 65, suction controller 66, print controller 67, die cutting controller 68, first correction unit 69, and second correction unit 70.

The conveyance controller 65 drives the conveyance motor 52 to convey the label paper 5 by the conveyance mechanism 10, and indexes the printing start position on the label 4 to the printing position A based on the output from the label position detector 24 and the print data. In the indexing operation the conveyance controller 65 conveys the label paper 5 until the label position detector 24 detects a black mark BM. Based on the print data, the conveyance controller 65 then conveys the label paper 5 a specific conveyance distance to set the printing start position on the label 4 to the printing position A.

As in the first embodiment, the die cutting controller 68 has a die cutting data generator 71 and drive controller 72.

Based on the die cutting data, the conveyance controller 65 conveys the label paper 5 from the printing position A to the die cutting position B. More specifically, as shown in FIG. 6, when die cutting data is generated by the die cutting data generator 71, the conveyance controller 65 calculates the defined conveyance distance M of the label paper 5 based on the distance D between the printing position A and die cutting position B, the distance E between the black mark BM and the printing start position, and first dimension L1, which is the width of the margin to the printing area Pin the conveyance direction X. This defined conveyance distance M is calculated by the following equation (1).

$$M=D-E+L1 \quad (1)$$

When the label paper 5 is conveyed defined conveyance distance M from the printing position A toward the die cutting position B, the first correction unit 69 corrects the offset in the conveyance direction X between the actual striking position U1 where the wire pins 41 strike the label paper 5 and the previously set target striking position U2 on the label paper 5.

In this example, the first correction unit 69 adjusts the conveyance distance of the label paper 5 between the printing position A and die cutting position B based on the conveyance direction offset <1 between the actual striking position U1 and target striking position U2 in the conveyance direction X of the label paper 5, and the conveyance controller 65 controls conveying the label paper 5 based on the corrected conveyance distance. More specifically, when the printing area P and the die cutting area C on the label paper 5 shift on the conveyance direction X due to a shift in the actual striking position U1 from the target striking position U2, the die cutting area C is moved in the conveyance direction X and the offset is corrected by the first correction unit 69 adjusting the conveyance distance between the printing position A and die cutting position B.

More specifically, the conveyance direction offset $\alpha$1 in the conveyance direction X between the actual striking position U1 and target striking position U2 is added to the result of equation (1) to calculate a corrected defined conveyance distance M1, and the conveyance controller 65 then controls conveying the label paper 5 the corrected defined conveyance distance M1 between the printing position A and die cutting position B. In other words, the first correction unit 69 corrects the defined conveyance distance M calculated by the conveyance controller 65 to the corrected defined conveyance distance M1 acquired from equation (2) below. The conveyance direction offset $\alpha$1 is a negative value if the actual striking position U1 is downstream on the conveyance direction X from the target striking position U2, and is a positive value if on the upstream side.

$$M1=D-E+L1+\alpha 1 \quad (2)$$

The first correction unit 69 also has an input unit 69*a* (not shown in the figure) for receiving input of the conveyance direction offset α1. The input unit 69*a* receives a conveyance direction offset α1 input from an external device through the communication unit 61 to the controller 60. Note that the input unit 69*a* of the first correction unit 69 may be disposed to an operating panel of the printer 1, and input of the conveyance direction offset α1 may be received from this input unit 69*a*.

The conveyance direction offset α1 is acquired by executing the printing operation and the die cutting operation on the label paper 5 and acquiring the printing and die cutting results. More specifically, the operator manually measures and acquires the conveyance direction offset α1 between the printing area P and die cutting area C from the results of printing and die cutting the label paper 5, and uses this as the conveyance offset between the actual striking position U1 and target striking position U2. A scanner or other device may also be used to acquire the conveyance direction offset α1.

When the label paper 5 is conveyed defined conveyance distance M or corrected defined conveyance distance M1 from the printing position A to the die cutting position B, the second correction unit 70 corrects the offset in the primary scanning direction Y between the actual striking position U1 where the wire pins 41 strike the label paper 5 and the previously set target striking position U2 on the label paper 5.

In this example, the second correction unit 70 corrects the timing when the die cutting controller 68 drives the wire pin drive mechanism 42 based on the primary scanning direction offset α2 between the actual striking position U1 and target striking position U2 on the label paper 5 in the primary scanning direction Y. More specifically, when the printing area P and die cutting area C on the recording paper are offset in the primary scanning direction Y due to the actual striking position U1 shifting relative to the target striking position U2, the second correction unit 70 adjusts the timing for driving the wire pins of the wire dot head 27 moving in the primary scanning direction Y, and moves the die cutting area C on the primary scanning direction Y.

For example, as shown in FIG. 7, when the actual striking position U1 moves to one side Y1 of the primary scanning direction Y relative to the target striking position U2, the second correction unit 70 delays the timing for driving the wire pin drive mechanism 42 (the timing for energizing the drive coil 48) when the wire dot head 27 is moving to the other side Y2 in the primary scanning direction Y. When the wire dot head 27 is moving to the one side Y1 of the primary scanning direction Y, the second correction unit 70 advances the timing for driving the wire pin drive mechanism 42 (the timing for energizing the drive coil 48). As a result, the second correction unit 70 moves the actual striking position U1 where the wire pins 41 strike the label paper 5 toward the other side Y2 of the primary scanning direction Y, and moves the die cutting area C toward the other side Y2 of the primary scanning direction Y.

If the actual striking position U1 is on the other side Y2 of the target striking position U2 in the primary scanning direction Y, the second correction unit 70 advances the timing for driving the wire pin drive mechanism 42 (the timing for energizing the drive coil 48) when the wire dot head 27 is moving to the other side Y2 in the primary scanning direction Y. When the wire dot head 27 is moving to the one side Y1 of the primary scanning direction Y, the second correction unit 70 delays the timing for driving the wire pin drive mechanism 42 (the timing for energizing the drive coil 48). As a result, the second correction unit 70 moves the actual striking position U1 where the wire pins 41 strike the label paper 5 toward the one side Y1 of the primary scanning direction Y, and moves the die cutting area C toward the one side Y1 of the primary scanning direction Y. The time that the timing for driving the wire pin drive mechanism 42 is shifted corresponds to the primary scanning direction offset α2.

The second correction unit 70 also has an input unit 70*a* (not shown in the figure) for receiving input of the primary scanning direction offset α2. The input unit 70*a* receives a primary scanning direction offset α2 input from an external device through the communication unit 61 to the controller 60. Note that the input unit 70*a* of the second correction unit 70 may be disposed to an operating panel of the printer 1, and input of the primary scanning direction offset α2 may be received from this input unit 70*a*.

The primary scanning direction offset α2 is acquired by executing the printing operation and the die cutting operation on the label paper 5 and acquiring the printing and die cutting results. More specifically, the operator manually measures and acquires the primary scanning direction offset α2 between the printing area P and die cutting area C from the results of printing and die cutting the label paper 5, and uses this as the primary scanning direction offset between the actual striking position U1 and target striking position U2. A scanner or other device may also be used to acquire the primary scanning direction offset α2.

Printing and Die Cutting Operation

Figure 8:
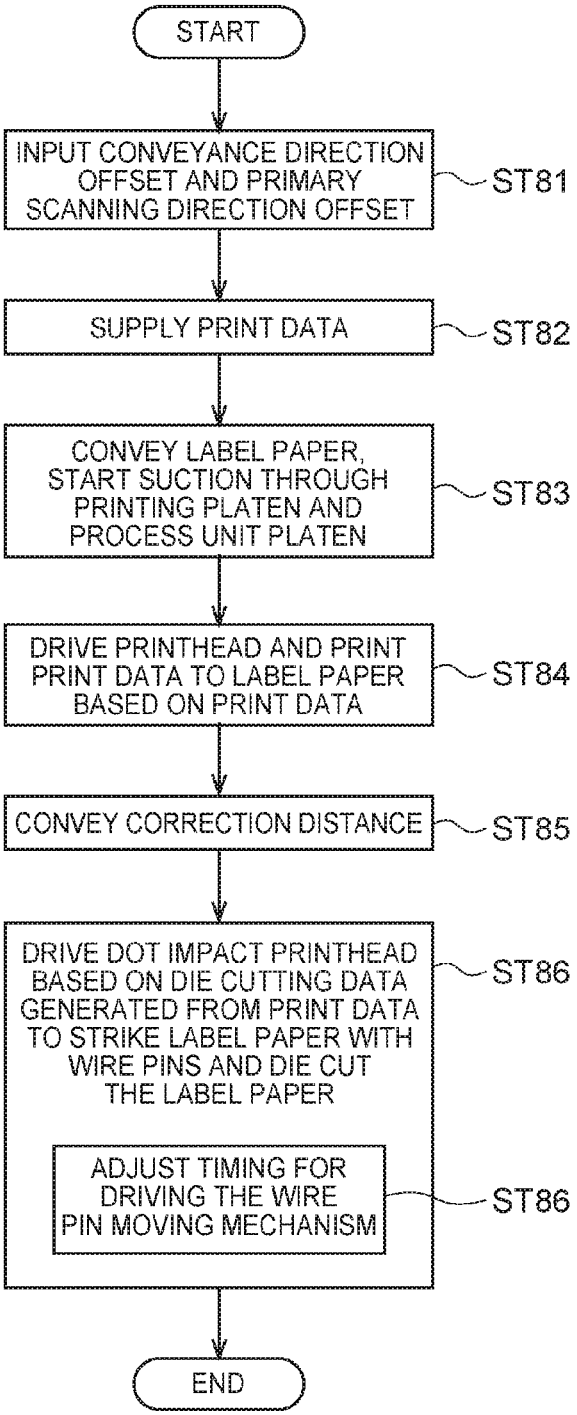
FIG. 8 is a flow chart of the printing and die cutting operation of the printer.

FIG. 8 is a flow chart of the printing and die cutting operation of the printer 1. As shown in FIG. 8, the printing and die cutting operations are first executed on the label paper 5, and the operator measures the conveyance direction offset α1 and primary scanning direction offset α2. The operator inputs the acquired conveyance direction offset α1 and primary scanning direction offset α2 to an external device, and the printer 1 receives and acquires the conveyance direction offset α1 and primary scanning direction offset α2 from the external device (step ST81).

The printer 1 then receives print data from the external device (step ST82). Upon receiving the print data, the printer 1 drives the conveyance motor 52 to intermittently convey the label paper 5 through the conveyance path 9. The printer 1 also drives the printer-side suction pump 15 and process unit-side suction pump 30, and suctions air through the printing platen 13 and process unit platen 28 (step ST83).

Next, the printer 1 drives the printhead 12 and printer-side carriage motor 23 based on the print data, and prints the print data on the label paper 5 at the printing position A on the conveyance path 9 (step ST84). The printer 1 also generates the die cutting data based on the print data, and conveys the label paper 5 toward the die cutting position B.

During this conveyance operation, the printer 1 corrects the defined conveyance distance M based on the conveyance direction offset α1, and conveys the label paper 5 based on the corrected defined conveyance distance M1 (step ST85). As a result, the actual striking position U1 where the wire pins 41 strike the label paper 5 is aligned with the target striking position U2 in the conveyance direction X.

The printer 1 then performs the die cutting operation to die cut the label paper 5. In other words, the printer 1 drives the wire dot head 27 (wire pin drive mechanism 42) and process unit-side carriage motor 38 based on the die cutting data, and strikes the label paper 5 on the conveyance path 9 with the wire pins 41 (step ST86).

In the die cutting operation (striking operation), the printer 1 corrects the timing for driving the wire pin drive mechanism 42 of the wire dot head 27 by a time corresponding to the primary scanning direction offset α2 (step ST861). As a result, the actual striking position U1 where the wire pins 41 strike the label paper 5 aligns with the target striking position U2 in the primary scanning direction Y.

The printer 1 in this example die cuts the label paper 5 by striking the label paper 5 on the conveyance path 9 with wire pins 41 of the wire dot head 27. Based on the die cutting data generated based on the print data, the printer 1 also controls the wire dot head 27 to die cut the label paper 5. The printer 1 can therefore die cut the label paper 5 to a shape conforming to the printing area P of the print data. Because a wire dot head 27 is used for die cutting the label paper 5 in this example, the wire pin drive mechanism 42 can be easily controlled based on the die cutting data.

In addition, when the printing area P and die cutting area C on the label paper 5 shift in the conveyance direction X because the actual striking position U1 where the wire dot head 27 drives the wire pin 41 is offset from the target striking position U2, the printer 1 in this example corrects the amount the label paper 5 is conveyed from the printing position A to the die cutting position B from defined conveyance distance M to corrected defined conveyance distance M1. As a result, the actual striking position U1 aligns with the target striking position U2 in the conveyance direction X.

Furthermore, when the printing area P and die cutting area C on the label paper 5 are offset in the primary scanning direction Y because the actual striking position U1 where the wire dot head 27 drives the wire pin 41 is offset from the target striking position U2, the printer 1 in this example shifts the timing for driving the wire pin drive mechanism 42 of the wire dot head 27 moving in the primary scanning direction Y, and moves the die cutting area C in the primary scanning direction Y. As a result, the actual striking position U1 aligns with the target striking position U2 in the primary scanning direction Y.

Other Examples of Embodiment 2

The first correction unit 69 may control the conveyance mechanism 10 based on the offset between the actual striking position U1 and target striking position U2 in the conveyance direction X of the label paper 5, and move the printing start position of the print controller 67 on the label paper 5 in the conveyance direction X.

More specifically, when the printing area P and die cutting area C on the label paper 5 shift in the conveyance direction X as a result of the actual striking position U1 shifting relative to the target striking position U2, the first correction unit 69 moves the printing start position of the printhead 12 on the label paper 5 in the conveyance direction X, and can adjust the relative positions of the printing area P and die cutting area C. As a result, the offset between the printing area P and die cutting area C is corrected.

The second correction unit 70 may also adjust the timing for the print controller 67 to drive the printhead 12 based on the offset between the actual striking position U1 and target striking position U2 of the label paper 5 in the primary scanning direction Y.

More specifically, when the printing area P and die cutting area C on the label paper 5 shift in the primary scanning direction Y as a result of the actual striking position U1 shifting relative to the target striking position U2, the second correction unit 70 shifts the timing for driving the printhead 12 moving in the primary scanning direction Y, and moves the printing area P in the primary scanning direction Y. As a result, the offset between the actual striking position U1 and target striking position U2 is corrected.

The die cutting data generator 71 in the above example sets the die cutting area C based on the print data, but specific die cutting data may be previously registered and the die cutting operation performed based on the registered die cutting data. The die cutting process unit 8 in the above example also strikes the label paper 5 with wire pins 41 while moving the wire dot head 27 in the primary scanning direction Y to die cut the label paper 5, but the wire pins 41 may be arrayed in a line from one side to the other side of the conveyance path 9 in the primary scanning direction Y. In other words, a line head may be used as the wire dot head 27.

Embodiment 3

A third embodiment of the invention is described next with reference to accompanying figures.

Figure 9:
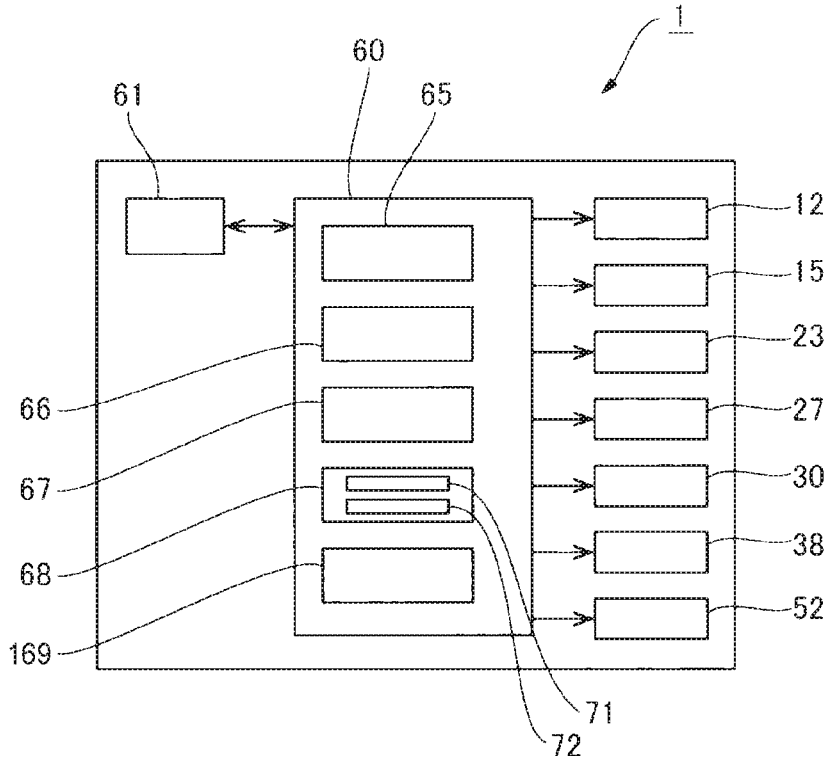
FIG. 9 is a block diagram illustrating another example of the printer control system.

FIG. 9 is a block diagram illustrating another example of a control system for the printer 1. The control system of the printer 1 is built around a controller 60 comprising a CPU and other parts. A communication unit 61 is connected to the controller 60. The printhead 12, printer-side suction pump 15, printer-side carriage motor 23, wire dot head 27, processing unit-side suction pump 30, processing-unit side carriage motor 38, and conveyance motor 52 are connected to the output side of the controller 60.

The controller 60 includes a conveyance controller 65, suction controller 66, print controller 67, die cutting controller 68, and striking force controller 169 (striking force adjustment unit).

As in the first embodiment, the die cutting controller 68 has a die cutting data generator 71 and drive controller 72.

The striking force controller 169 sets the striking force whereby the drive controller 72 strikes the label paper 5 with the wire pins 41 to a first striking force at which the wire pins 41 pass through the label 4, and a second striking force at which the wire pins 41 pass through both the label 4 and liner 3.

In this example, the striking force controller 169 controls energizing the drive coil 48 by the drive controller 72 to adjust the striking force. More specifically, the striking force controller 169 adjusts the current or voltage the drive controller 72 supplies to the drive coil 48, or the energizing time. When power is supplied to the drive coil 48 as pulses, the striking force controller 169 adjusts the pulse width the drive controller 72 supplies to the drive coil 48. As a result, the speed (acceleration) at which the electromagnetic actuator 47 moves the wire pin 41 changes and the striking force of the wire pins 41 against the label paper 5 is adjusted.

For example, to strike with the first striking force, the striking force controller 169 may set the current supplied by the drive controller 72 to the drive coil 48 to a first current. To strike with the second striking force, the striking force controller 169 may set the current supplied by the drive controller 72 to the drive coil 48 to a second current that is greater than the first current.

Alternatively, to strike with the first striking force, the striking force controller 169 may set the voltage supplied by the drive controller 72 to the drive coil 48 to a first voltage. To strike with the second striking force, the striking force controller 169 may set the voltage supplied by the drive controller 72 to the drive coil 48 to a second voltage that is greater than the first voltage.

Further alternatively, to strike with the first striking force, the striking force controller 169 may control the drive controller 72 to supply power to the drive coil 48 for a first energizing time (pulse width). To strike with the second striking force, the striking force controller 169 may control the drive controller 72 to supply power to the drive coil 48 for a second energizing time (pulse width) that is longer than the first energizing time (pulse width).

A configuration command for setting the striking force of the wire pins 41 against the label paper 5 to the first striking force or the second striking force is input from an external device to the printer 1. Based on this configuration command, the striking force controller 169 adjusts the striking force. Note that the operator may alternatively input a configuration command from an operating panel (input unit) not shown of the printer 1 to change the striking force.

When the thickness of the liner 3 or the thickness of the label 4 is input from an external device to the printer 1, the striking force controller 169 may also be configured to set the current, voltage, or energizing time required to achieve the desired first striking force or second striking force based on the input thickness information.

Printing and Die Cutting Operation

Figure 10:
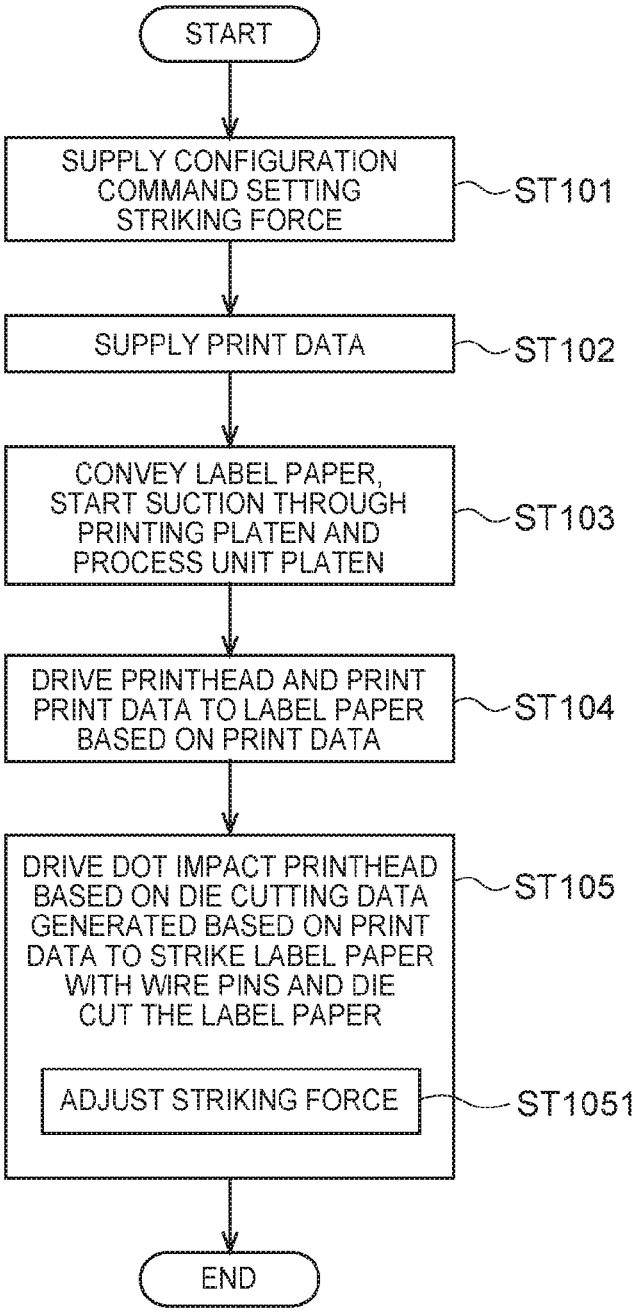
FIG. 10 is a flow chart of the printing and die cutting operation of the printer.

FIG. 10 is a flow chart of the printing and die cutting operation of the printer 1. In this example, a configuration command setting the striking force of the wire pins 41 against the label paper 5 to the first striking force is generated by an external device, and the printer 1 receives the configuration command supplied from the external device (step ST101).

The printer 1 receives print data supplied from an external device (step ST102). Upon receiving the print data, the printer 1 drives the conveyance motor 52 to intermittently convey the label paper 5 through the conveyance path 9. The printer 1 drives the printer-side suction pump 15 and process unit-side suction pump 30, and suctions air through the printing platen 13 and process unit platen 28 (step ST103).

Next, the printer 1 drives the printhead 12 and printer-side carriage motor 23 based on the print data, and prints the print data on the label paper 5 on the conveyance path 9 at the printing position A (step ST104). The printer 1 also generates the die cutting data based on the print data, and based on the die cutting data, then drives the wire dot head 27 (wire pin drive mechanism 42) and the process unit-side carriage motor 38 to die cut the label paper 5 (step ST105).

In the die cutting operation of step ST105, the striking force controller 169 controls supplying power to the drive coil 48 by the drive controller 72, and adjusts the striking force of the wire pins 41 on the label paper 5 to the first striking force (step ST1051). As a result, the label 4 is kiss cut and the liner 3 is not cut in the die cutting operation in this example.

If a configuration command setting the striking force to the second striking force is input to the printer 1 from the external device in step ST101, the striking force of the wire pins 41 against the label paper 5 set by the striking force controller 169 in step ST1051 is the second striking force. As a result, the label 4 and the liner 3 are both die cut in the die cutting operation.

The printer 1 in this example die cuts the label paper 5 by striking the label paper 5 on the conveyance path 9 with wire pins 41 of the wire dot head 27. Based on the die cutting data generated based on the print data, the printer 1 also controls the wire dot head 27 to die cut the label paper 5. The printer 1 can therefore die cut the label paper 5 to a shape conforming to the printing area P of the print data. Because a wire dot head 27 is used for die cutting the label paper 5 in this example, the wire pin drive mechanism 42 can be easily controlled based on the die cutting data.

Furthermore, by adjusting the striking force of the wire pins 41 against the label paper 5, the printer 1 according to this embodiment can flexibly set the depth of the die cut in the label paper 5. The printer 1 can therefore flexibly change between a die cut process cutting both the label 4 and liner 3, and a die cut process kiss-cutting only the label 4.

Furthermore, because the printer 1 can adjust the striking force of the wire pins 41 on the label paper 5 in this example, when the thickness of the label 4, the thickness of the liner 3, or other thickness dimensions are previously input to the printer 1, the striking force can be adjusted based on the input thickness information.

Other Examples of Embodiment 3

The striking force controller 169 adjusts the striking force of the wire pins 41 on the label paper 5 in the above example by controlling energizing the wire dot head 27, but the striking force of the wire pins 41 on the label paper 5 may also be adjusted by adjusting the gap between the wire dot head 27 and the conveyance path 9 (process unit platen 28).

When the gap between the wire dot head 27 and the conveyance path 9 (process unit platen 28) is adjusted, a gap adjustment mechanism 75 is disposed to the die cutting process unit 8 as indicated by the dotted line in FIG. 1. The striking force controller 169 also drives the gap adjustment mechanism 75 to adjust the gap between the wire dot head 27 and conveyance path 9. In other words, the printer 1 uses the striking force controller 169 and gap adjustment mechanism 75 as a striking force adjustment unit.

Configurations known from the literature may be used as the gap adjustment mechanism 75. For example, the gap adjustment mechanism 75 may be configured with a support mechanism that supports the ends of the carriage guide rail 34 by a pair of eccentric cams, and a drive motor for rotationally driving the eccentric cams. As a result, the striking force controller 169 can move the carriage guide rail 34 in the direction toward and in the direction away from the conveyance path 9 by driving the drive motor to turn the eccentric cams. As a result, the gap between the process unit platen 28 and the wire dot head 27 carried on a carriage supported by the carriage guide rail 34 is adjusted.

The gap adjustment mechanism 75 may also be configured from an eccentric carriage guide rail 34 and a drive motor that turns the carriage guide rail 34 on its axis. In this case, the gap between the process unit platen 28 and the wire dot head 27 carried on a carriage supported by the carriage guide rail 34 is adjusted by the striking force controller 169 driving the drive motor to turn the carriage guide rail 34.

If the gap adjustment mechanism 75 reduces the gap between the wire dot head 27 and process unit platen 28, the striking force of the wire pins 41 on the label paper 5 increases. The second striking force for die cutting the label 4 and liner 3 can therefore be achieved by the gap adjustment mechanism 75 reducing setting the wire dot head 27 and process unit platen 28 closer together. If the gap adjustment mechanism 75 moves the wire dot head 27 and process unit platen 28 apart, the striking force of the wire pins 41 on the label paper 5 is reduced and the first striking force for kiss cutting the label 4 only can be achieved.

Therefore, in the die cutting operation (step ST105) in the flow chart in FIG. 10, the striking force controller 169 drives the drive motor based on the configuration command to adjust the gap between the wire dot head 27 and process unit platen 28 (step ST1051). As a result, the striking force is set to the first striking force or the second striking force.

A continuous line is converted to the die cutting data in the example above, but a dotted-line contour may also be converted to die cutting data. Die cutting in this case forms a perforated line. Because the perforation is formed based on die cutting data (print data), the length of the cuts in the perforation, and the interval between one cut and the next cut, can be configured as desired. A perforation following a curve can also be cut. Two mutually intersecting perforations can also be easily formed.

Die cutting data may also be included in the print data supplied to the printer 1. In this case, the die cutting controller 68 drives the wire dot head 27 (wire pin drive mechanism 42) and process unit-side carriage motor 38 based on the die cutting data contained in the print data to strike the label paper 5 on the conveyance path 9 with the wire pins 41 at the die cutting position B.

The print unit 7 and then the die cutting process unit 8 are disposed from the upstream side to the downstream side in the conveyance direction X of the label paper 5 in the above example, but the die cutting process unit 8 may be on the upstream side and the print unit 7 disposed downstream therefrom.

The die cutting data generator 71 in the above example defines the die cutting area C based on the print data, but specific die cutting data may be previously registered and the die cutting operation performed based on the registered die cutting data. The die cutting process unit 8 in the above example also strikes the label paper 5 with wire pins 41 while moving the wire dot head 27 in the primary scanning direction Y to die cut the label paper 5, but the wire pins 41 may be arrayed in a line (like a line head) from one side to the other side of the conveyance path 9 in the primary scanning direction Y. In other words, a line head may be used as the wire dot head 27.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A label die cutting device comprising:
- a conveyance path through which label paper is conveyed;
- a die cutting unit having wire pins and a wire pin moving mechanism that drives the wire pins forward and back;
- a die cutting controller configured to drive the wire pin moving mechanism to advance the wire pins, strike the label paper on the conveyance path with the wire pins, and die cut the label paper based on print data; and
- a striking force controller configured to adjust the striking force of the wire pins striking the label paper,
- wherein the striking force controller has a gap adjusting mechanism configured to adjust the gap between the die cutting unit and the conveyance path.

2. The label die cutting device described in claim 1, wherein the die cutting unit is a wire dot head.

3. The label die cutting device described in claim 1, wherein the wire pins have a rectangular shape when seen from the axial end.

4. The label die cutting device described in claim 1,
- the wire pin moving mechanism having a drive coil that drives the wire pins;
- the die cutting controller drives the wire pin moving mechanism by energizing the drive coil; and
- the striking force controller controls energizing the drive coil and adjusts the striking force.

5. The label die cutting device described in claim 1, wherein the striking force controller sets the striking force of the wire pins against the label paper to a first striking force causing the wire pins to pass through the label, or a second striking force causing the wire pins to pass through the label and the liner.

6. A printing device comprising:
- a printhead;
- a die cutting unit having wire pins and a wire pin moving mechanism that drives the wire pins forward and back;
- a conveyance path through which label paper is conveyed;
- a conveyance mechanism configured to convey the label paper through the conveyance path;
- print control unit configured to drive the printhead based on print data and print on the label paper on the conveyance path;
- a die cutting controller configured to drive the wire pin moving mechanism to advance the wire pins, strike the label paper on the conveyance path with the wire pins, and die cut the label paper based on the print data; and
- a striking force controller configured to adjust the striking force of the wire pins striking the label paper,
- wherein the striking force controller has a gap adjusting mechanism configured to adjust the gap between the die cutting unit and the conveyance path.

7. The printing device described in claim 6, further comprising:
- a first platen defining a first conveyance path part opposite the printhead on the conveyance path; and
- a second platen defining a second conveyance path part opposite the die cutting unit on the conveyance path;
  - the first platen and the second platen being suction platens; and
  - a suction mechanism including the second platen.

8. The printing device described in claim 6, further comprising:
- a printer module and an auxiliary module that is removably installable to the printer module;
- the conveyance path including a first conveyance path part and a second conveyance path part that connect disconnectably;
- the printer module including the first conveyance path part and the printhead; and
- the auxiliary module including the second conveyance path part and the die cutting unit.

9. The printing device described in claim 6, further comprising:
- a conveyance controller configured to drive the conveyance mechanism based on the print data; and
- a correction unit configured to correct offset between the striking position where the die cutting unit strikes the label paper with the wire pins, and a target striking position previously set on the label paper.

10. The printing device described in claim 9, wherein:
- the correction unit controls the conveyance mechanism and adjusts the conveyance distance of the label paper from the printing position to the die cutting position based on the offset between the striking position and the target striking position in the conveyance direction of the label paper.

11. The printing device described in claim 9, wherein:
- the correction unit controls the conveyance mechanism based on the offset in the conveyance direction of the label paper between the striking position and the target striking position, and moves the printing start position where the print control unit starts printing on the label paper in the conveyance direction.

12. The printing device described in claim 9, further comprising:

a printhead moving mechanism configured to move the printhead transversely to the conveyance direction of the label paper;

the print control unit driving the printhead and printing on the label paper while driving the printhead moving mechanism to move the printhead in the transverse direction, and the correction unit correcting the timing at which the print control unit drives the printhead based on the offset in the transverse direction between the striking position and the target striking position.

13. The printing device described in claim 9, the correction unit having an input unit to receive the offset amount.

14. A label die cutting method controlling a device including a conveyance path through which label paper is conveyed, wire pins, and a wire pin moving mechanism that drives the wire pins forward and back, the method comprising;

receiving print data;

conveying label paper through the conveyance path;

driving the wire pin moving mechanism to advance the wire pins, strike the label paper on the conveyance path with the wire pins, and die cut the label paper based on the print data; and adjust the striking force of the wire pins striking the label paper, wherein adjusting the striking force comprises adjusting a gap between the die cutting unit and the conveyance path.

15. The label die cutting method described in claim 14, further comprising:

in the die cutting operation, setting the striking force of the wire pins against the label paper to a first striking force causing the wire pins to pass through the label, or a second striking force causing the wire pins to pass through the label and the liner.

* * * * *